US007215911B2

(12) United States Patent
Kim et al.

(10) Patent No.: US 7,215,911 B2
(45) Date of Patent: May 8, 2007

(54) IMAGE FORMING APPARATUS HAVING SUBSIDIARY CHARGE ROLLER

(75) Inventors: Young-min Kim, Suwon-si (KR); Byung-sun Ahn, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 154 days.

(21) Appl. No.: 10/899,111

(22) Filed: Jul. 27, 2004

(65) Prior Publication Data

US 2005/0141925 A1 Jun. 30, 2005

(30) Foreign Application Priority Data

Dec. 29, 2003 (KR) ..... 10-2003-0099099

(51) Int. Cl.
*G03G 15/08* (2006.01)

(52) U.S. Cl. ..... 399/281; 399/284

(58) Field of Classification Search ..... 399/284, 399/281, 279, 274, 53, 253
See application file for complete search history.

(56) References Cited

U.S. PATENT DOCUMENTS 5,839,021 A 11/1998 Hayashi et al. ..... 399/55
6,229,979 B1 * 5/2001 Ishii et al. ..... 399/281
6,415,127 B1 * 7/2002 Yamamoto et al. ..... 399/284
2001/0021329 A1 * 9/2001 Nittani et al. ..... 399/281
2001/0028816 A1 10/2001 Kakeshita et al. ..... 399/281
2002/0001486 A1 1/2002 Kamimura et al. ..... 399/281
2002/0141790 A1 10/2002 Kamimura et al. ..... 399/279

FOREIGN PATENT DOCUMENTS

JP 57-006856 A * 1/1982
JP 02-282768 A * 11/1990
JP 07-064392 A * 3/1995
JP 11-167275 6/1999
KR 2000-0062698 10/2000

* cited by examiner

*Primary Examiner*—Sophia S. Chen
(74) *Attorney, Agent, or Firm*—Roylance, Abrams, Berdo & Goodman, LLP

(57) ABSTRACT

An image forming apparatus including a subsidiary charge roller and a development roller, wherein the diameter ratio I of the subsidiary charge roller to the development roller is in the range of 0.45 to 0.8. The subsidiary charge roller and the development roller can be arranged such that the linear velocity of the subsidiary charge roller Vs is larger than the linear velocity of the development roller Vd, and preferably the linear velocity ratio K of the subsidiary charge roller to the development roller is in the range of 1.01 to 1.06. Alternatively, the image forming apparatus can further include a compression section for applying a predetermined pressure to the opposite ends of the shaft of the subsidiary roller and a development roller gear coaxially formed on the development roller shaft.

25 Claims, 7 Drawing Sheets

IMAGE FORMING APPARATUS HAVING SUBSIDIARY CHARGE ROLLER

CROSS-REFERENCE TO RELATED APPLICATIONS

This application claims the benefit under 35 U.S.C. §119 (a) of Korean Patent Application No. 2003-99099 entitled "Image Forming Apparatus Having Subsidiary Charge Roller", filed in the Korean Intellectual Property Office on Dec. 29, 2003, the entire contents of which are incorporated herein by reference.

BACKGROUND OF THE INVENTION

1. Field of the Invention

The present invention relates to an electrophotographic image forming apparatus such as a copying machine, a facsimile apparatus, and a laser printer. More particularly, the present invention relates to an image forming apparatus having a subsidiary charge roller which allows developer attached to a development roller to be evenly charged.

2. Description of the Related Art

In general, an electrophotographic image forming apparatus such as a laser beam printer, copying machine and facsimile apparatus, obtains a permanent image formed by the steps of first contacting developer containing fine toner particles with a development roller such that the developer is attached to the development roller, and then rendering the toner particles contained in the attached developer to be selectively attached to an electrostatic latent image by electrostatic force using suitable voltage bias, thereby forming a toner image. The electrostatic latent image is preferably formed on a photosensitive conductor which is formed from a conductive material. The apparatus then transfers the toner image to a paper which is more highly charged than the photosensitive conductor, and fixes the toner image using heat and pressure.

FIG. 1 shows a cross-sectional view of such a conventional image forming apparatus.

The image forming apparatus 10 comprises a photosensitive conductor 1 in the form of a cylindrical drum rotating in a predetermined direction, as indicated by arrow A in FIG. 1, with a predetermined shaft speed. The apparatus further includes a charging unit 2, such as a contact charge roller, for charging the surface of the photosensitive conductor 1 to a predetermined potential. An exposure unit 3 is provided for scanning laser beams onto the surface of the photosensitive conductor 1 in response to an image signal, thus forming an electrostatic latent image.

A development unit 4 is provided for attaching developer 18 to the electrostatic latent image formed on the surface of the photosensitive conductor 1, thereby developing the developer 18 into a visible image. A transfer unit 9 is then provided for transferring the developer 18 developed into the visible image onto a paper 13, and a fixation unit 12 is provided for fixing the developer 18 transferred onto the paper 13 using heat and pressure. A paper discharge unit 14 is finally provided for discharging the paper out of the apparatus.

The development unit 4 comprises a development roller 5 spaced from the photosensitive conductor 1 by a developing gap 'd', and a developer supply roller 6 for supplying developer 18 to the development roller 5, wherein the developer supply roller 6 is located adjacent to the development roller 5 and rotating in a same direction with the development roller 5 as indicated by arrow B in FIG. 1. The unit 4 further includes a stirring roller 16 for stirring developer 18 contained in a developer bin 17, and a developer layer regulation member 7 for regulating a developer layer formed on the development roller 5. A subsidiary charge roller 8 is provided for more evenly charging the developer layer formed by the developer layer regulation member 7, and a leakage prevention member 15 is provided for preventing the developer from leaking out, wherein the leakage prevention member is located below the development roller 5.

The image forming apparatus 10 constructed in this manner can be operated as follows. In a first step, the photosensitive conductor 1 having a surface being charged with a predetermined voltage via the charging unit 2, rotates in the direction indicated by arrow A in FIG. 1.

At this time, laser beams emitted from the exposure unit 3 are scanned onto the photosensitive conductor 1 in response to an image signal, whereby an electrostatic latent image is formed on the surface of the photosensitive conductor 1.

The developer 18 is then moved from the developer bin 17 by the stirring roller 16, to the developer supply roller 6, which is rotating in the direction indicated by arrow B in FIG. 1.

The developer 18 which arrives at the developer supply roller 6, is moved to and attached to the development roller 5 due to a difference in potential between a developer supply bias voltage (for example, −400V to −800V) applied to the developer supply roller 6, and a developing bias voltage (for example, −200V to −600) applied to the development roller 5. The developer 18 is moved into a nip between the development roller 5 and the developer supply roller 6, wherein the development roller 5 rotates in the same direction with the developer supply roller 6.

At this time, although the developer 18 is charged with a negative (−) polarity by the developer supply roller 6 and the development roller 5, the developer 18 contains a mix of toner particles, some charged with a negative (−) polarity and some non-charged (neutral) particles.

Thereafter, as the development roller 5 continuously rotates, the developer 18 is formed into about one to six developer layers on the surface of the development roller 5 by the developer layer regulation member 7. The developer 18 formed on the surface of the development roller 5 then moves into the nip between the subsidiary charge roller 8 and the development roller 5 after, or downstream of the developer layer regulation member 7 in the rotational direction of the development roller 5, wherein the subsidiary charge roller 8 rotates in the direction opposite to that of the development roller 5.

At this time, all the toner particles existing in the developer 18 are charged with a negative (−) polarity because the non-charged toner particles noted above are now charged by the subsidiary charge roller 8, to which a voltage in the range of about −500 V to −2000 V is applied.

The developer 18 then moves to the surface of the photosensitive conductor 1 in the developing area where the developing gap 'd' is formed between the development roller 5 and the photosensitive conductor 1. At this point, the developer 18 is attached to an electrostatic latent image formed on the surface of the photosensitive conductor 1, thereby being developed into a visible image.

As the photosensitive conductor 1 rotates, the developer 18 attached to the photosensitive conductor 1 is transferred to a paper 13, which is fed between the photosensitive conductor 1 and the transfer roller 9 located below the photosensitive conductor 1.

As the photosensitive conductor 1 continues to rotate, non-transferred developer left on the latent image area on the surface of the photosensitive conductor 1 is removed by a cleaning blade 19 and is captured by bin 11. The image transferred to the paper 13 is fixed to the paper 13 by the fixation unit 12, and the paper 13 is then discharged out of the apparatus by the paper discharge unit 14.

The conventional image forming apparatus 10 constructed as described above is generally arranged in such a manner that the diameter ratio (I=D2/D1) between the diameter D1 of the development roller 5 and the diameter D2 of the subsidiary charge roller 8 is not more than 0.45. For example, if the diameter D1 of the development roller 5 is 16 mm, the diameter D2 of the subsidiary charge roller 8 is set to be 7 mm or less, whereby the diameter ratio I will be less than 0.45 (I=0.4375).

However, if the diameter ratio I between the development roller 5 and the subsidiary charge roller 8 is too small, in other words, if the difference between the diameters of the development roller 5 and the subsidiary charge roller 8 is too large, the amount of nip between the development roller 5 and the subsidiary charge roller 8 decreases as shown in FIG. 2. In this case, the developer 18 is unevenly charged, and the adhesive force is insufficient to attach the developer to the development roller 5 because the developer 18 does not have a sufficient length of time for charge, which causes the developer 18 to be scattered.

In addition, if the difference in diameter between the development roller 5 and the subsidiary charge roller 8 is too large, the angle will be abruptly changed from the ingoing area $\alpha$ to the outgoing area $\beta$ of the nip between the development roller 5 and the subsidiary charge roller 8. Therefore, when developer 18 enterers the nip between the development roller 5 and the subsidiary charge roller 8, the developer 18 will not be evenly charged, whereas when the developer leaves the nip, there will not be sufficient time to remove the offset of developer from the subsidiary charge roller 8 which is produced in the nip. Therefore, the surface of the subsidiary charge roller 8 will become contaminated by the developer 18 when the apparatus is used over a long period, a result of which is the developer 18 will not be evenly charged.

Furthermore, if the diameter D2 of the subsidiary charge roller 8 is too small as compared to the diameter D1 of the development roller 5, the rotational speed of the subsidiary charge roller 8 becomes too rapid, thereby causing the developer 18 to be scattered.

Such unevenness of charge and scattering of the developer 18 will produce image defects such as background, reverse development or reverse transfer, white spots, black spots, and so forth, and can result in the contamination of the photosensitive conductor 1 and the subsidiary charge roller 8, thereby reducing the life-span of the development unit.

As shown in FIG. 3, in the conventional image forming apparatus 10, the subsidiary charge roller 8 comprises a rubber roller 8*a* and a metallic shaft 8*b* for fixing the rubber roller 8*a*.

The rubber roller 8*a* is typically formed in such a manner that the diameter Dc of the longitudinal center part is larger than the diameter Ds of the opposite ends thereof. However, the diameter Dc of the longitudinal center part can be formed smaller than the diameter Ds of the opposite ends of the roller, depending upon fabrication requirements for the rubber roller.

Therefore, regardless of how the subsidiary charge roller 8 is formed, it is needed and serves to compress the subsidiary charge roller 8 against the development roller 5 with a predetermined line pressure in order to assure that the subsidiary charge roller 8 and the development roller 5 come into contact with each other while forming a predetermined nip. For that purpose, the subsidiary charge roller 8 is secured to a fixed frame (not shown) such that it comes into contact with the development roller 5 with a predetermined line pressure.

However, if such a line pressure is created having a value which is too small, when the subsidiary charge roller 8 comes into contact with the development roller 5 the nip between the subsidiary charge roller 8 and the development roller 5 can become uneven due to the constructional characteristics of the subsidiary charge roller 8 due to manufacturing tolerances. In this case, the diameters Dc and Ds of the longitudinal center part and opposite ends thereof can be formed slightly different, whereby a problem can arise in that developer 18 in a developer layer formed on the development roller 5 can then be unevenly charged.

Such an unevenness of charge of the developer layer can cause problems such as a decreasing image density when a solid image, such as a black dot, is printed under a low-temperature and low-humidity environment. Such an unevenness of charge can further reduce the adhesive force of developer 18 to the development roller 5 under a high-humidity environment, thereby causing the developer 18 to be scattered or deteriorating the reproducing capability for a fine image.

In addition, if a line contact pressure between the subsidiary charge roller 8 and the development roller 5 becomes too large due to manufacturing tolerance, the nip between the subsidiary charge roller 8 and the development roller 5 will become too small, whereby the developer 18 will undergo increased stress in the nip, although the evenness of charge is not affected by the line pressure. Consequently, the developer in an image formed thereby will have a reduced life-span and the image will deteriorate as time passes. Moreover, in this case, because the subsidiary charge roller 8 or the development roller 5 is excessively compressed, a filming phenomenon can result which renders some of components of the developer or rubber to be attached to any of the surfaces of the subsidiary charge roller 8 and the development roller 5, or to the relatively softer one of the two rollers 5 and 8, which will then be deformed thus changing its diameter. As a result, it becomes difficult to form a normal nip between the two rollers 5 and 8.

Furthermore, in the conventional image forming apparatus 10, the subsidiary charge roller 8 is constructed to be driven with a linear velocity equal with that of the development roller 5 by the contact frictional force between the subsidiary charge roller 8 and the development roller 5, which are in contact with each other with a predetermined line pressure.

Accordingly, developer 18 is subject to relatively intense pressure when it is positioned in the nip area between the subsidiary charge roller 8 and the development roller 5 because the linear velocities of the two rollers 5 and 8 are substantially equal from the initiating point to the ending point of the nip. Therefore, the developer 18 will undergo stress, whereby the developer in an image formed thereby will have a reduced life-span and the image will deteriorate as time passes, like the case in which a high line pressure is exerted as described above.

In addition, if the subsidiary charge roller 8 is driven by the contact frictional force with the development roller 5, the subsidiary charge roller 8 is prone to slip, without rotating along with the development roller 5 when the development roller 5 is rotated rapidly in a high speed image forming apparatus. In this case, developer 18 on the development roller 5 will not be evenly charged, thereby causing problems such as inferior images due to the reduced density of developer, the scattering of developer due to the increased speed of the development roller 5, and the reduced adhesive force of the developer 18. Further, if the development roller 5 rapidly rotates, the difference in angular displacement between the development roller 5 and the subsidiary charge roller 8 will be increased. Therefore, the compressive pressure acting on the subsidiary charge roller 8 and the development roller 5 will be increased, whereby the rollers 5 and 8 will be worn away when used over a long period, thus causing inferior rotation of the rollers 5 and 8.

Moreover, if scattered developer and/or foreign matter is introduced into bearings (not shown) which are provided for supporting the opposite ends of the shaft 8*b* of the subsidiary charge roller 8, the subsidiary charge roller 8 cannot be smoothly rotated or stopped via the contact frictional force with the development roller 5. If the subsidiary charge roller 8 is not smoothly rotated or stopped as described above, a part or all of the developer 18 cannot pass through the nip between the subsidiary charge roller 8 and the development roller 5. Therefore, problems can arise in that inferior developments such as decreased density, white band, and streak phenomena can be caused in the developing area between the development roller 5 and the photosensitive conductor 1. Additionally, still other problems can arise in that the developer may be accumulated between the developer layer regulation member 7 and the subsidiary charge roller 8, thereby causing a contamination of developer, or an increase of the driving load of the driving roller, in which case, the entire development unit 4 cannot be used.

Finally, if the bearings supporting the opposite ends of the shaft 8*b* of the subsidiary charge roller 8 become worn out due to long-term use, the distance between the axes of the subsidiary charge roller 8 and the development roller 5 will be changed, whereby a nip may become unevenly formed between the subsidiary charge roller 8 and the development roller 5.

Accordingly, a need exists for a system and method to maintain a desired nip and rotational speed between a subsidiary charge roller and a development roller, regardless of manufacturing tolerances and other factors, such that developer is evenly charged and properly carried.

SUMMARY OF THE INVENTION

Accordingly, the present invention has been made to solve the above-mentioned and other problems occurring in the prior art, and wherein an object of the present invention is to provide an image forming apparatus comprising a subsidiary charge roller in which, the subsidiary charge roller is formed in such a manner that the diameter ratio of the subsidiary charge roller to a development roller is maintained within a predetermined range to substantially prevent deterioration of image quality due to uneven charge, contamination of the surface of the subsidiary charge roller due to the offset of developer on the subsidiary charge roller, and contamination of a development unit due to the scattering of developer.

Another object of the present invention is to provide an image forming apparatus comprising a subsidiary charge roller in which, the line pressure of the subsidiary charge roller against a development roller can be maintained within a predetermined range to substantially prevent the deterioration of image quality due to uneven charge, scattering of developer and decrease of image density under a specific environment. For example, these environments can include a low-temperature and low-humidity environment, and a high-temperature environment, which serve to decrease the life-span of the developer and deteriorate image quality due to increased stress of the developer.

Another object of the present invention is to provide an image forming apparatus comprising a subsidiary charge roller in which, the linear velocity ratio of the subsidiary roller to a development roller is adapted to be maintained within a predetermined range to substantially prevent a decrease in the life-span of the developer and the deterioration of image quality due to increased stress of the developer and uneven charge, and to further prevent such unevenness of charge due to slippage of the subsidiary charge roller.

Still another object of the present invention is to provide an image forming apparatus comprising a subsidiary charge roller which makes it possible to substantially prevent inferior development and contamination of developer, which can be caused due to the inferior operation of bearings supporting opposite ends of the shaft of the subsidiary charge roller.

In order to achieve the above objects of the present invention, an image forming apparatus is provided comprising a photosensitive conductor for forming a developer image, and a development roller for attaching developer to an electrostatic latent image formed on the surface of the photosensitive conductor, thereby developing the electrostatic latent image into the developer image. The apparatus also includes a developer layer regulation member for regulating a developer layer attached to the development roller, wherein the developer layer regulation member can be positioned adjacent to the development roller, and a subsidiary charge roller for charging the developer in the developer layer, wherein the subsidiary charge roller can be located after, or downstream of the developer layer regulation member in the rotational direction of the development roller such that the subsidiary charge roller comes into contact with the development roller with a predetermined pressure while forming a predetermined gap with the development roller. The diameter ratio I (I=D2/D1) of the subsidiary charge roller to the development roller is in the range of approximately 0.45 to approximately 0.8, and preferably in the range of approximately 0.5 to approximately 0.8.

According to an exemplary embodiment of the present invention, the subsidiary charge roller has a surface roughness Rz in the range of approximately 1 to approximately 15.

The surface of the subsidiary charge roller comprises at least one layer of conductive material containing a fluorine component. It is preferable that the subsidiary charge roller has an electrical resistance in the range of approximately $1\times10\ \Omega$ to approximately $1\times10^{10}\ \Omega$.

In addition, the amount of nip between the development roller and the subsidiary charge roller is preferably in the range of approximately 0.1 to approximately 1.0 mm.

According to another embodiment of the present invention, an image forming apparatus is provided comprising a photosensitive conductor for forming a developer image, and a development roller for attaching developer to the electrostatic latent image formed on the surface of the photosensitive conductor, thereby developing the electrostatic latent image into the developer image. The apparatus also includes a developer layer regulation member for regulating a developer layer attached to the development roller, the developer layer regulation member being positioned adjacent to the development roller, and a subsidiary charge roller for charging the developer in the developer layer, wherein the subsidiary charge roller can be located after, or downstream of the developer layer regulation member in the rotational direction of the development roller. The apparatus further includes a compression section for compressing the subsidiary charge roller against the development roller, whereby the subsidiary charge roller exerts a line pressure in the range of approximately 8 to approximately 100 gf/cm, preferably in the range of approximately 10 to approximately 50 gf/cm to the development roller.

According to an exemplary embodiment of the present invention, the compression section comprises one or more elastic springs arranged to compress the opposite ends of a shaft of the subsidiary charge roller with a predetermined pressure.

The line pressure is preferably calculated by summing a predetermined compressing pressure of the compression section and the weight of the subsidiary charge roller.

In addition, the amount of nip between the development roller and the subsidiary charge roller is preferably in the range of approximately 0.1 to approximately 3.0 mm.

According to another embodiment of the present invention, an image forming apparatus is provided comprising a photosensitive conductor for forming a developer image, and a development roller for attaching developer to the electrostatic latent image formed on a surface of the photosensitive conductor, thereby developing the electrostatic latent image into the developer image. The apparatus also includes a developer layer regulation member for regulating a developer layer deposited onto the development roller, wherein the developer layer regulation member can be positioned adjacent to the development roller, and a subsidiary charge roller for charging the developer in the developer layer, wherein the subsidiary charge roller can be located after, or downstream of the developer layer regulation member in the rotational direction of the development roller. In such a position, the subsidiary charge roller comes into contact with the development roller with a predetermined pressure while forming a predetermined gap with the development roller, and wherein the subsidiary charge roller is driven with a linear velocity Vs which is higher than the line velocity Vd of the development roller, as represented in the following equation (1):

$$Vs(Vs=D2*Ws)>Vd(Vd=D1*Wd) \quad (1)$$

wherein D2 denotes a diameter or outer diameter (mm) of the subsidiary charge roller, Ws denotes a rotational angular velocity (rad/sec) of the subsidiary charge roller, D1 denotes a diameter or outer diameter (mm) of the development roller, and Wd denotes a rotational angular velocity (rad/sec) of the development roller.

According to an exemplary embodiment of the present invention, the line velocity ratio K (K=Vs/Vd) of the subsidiary charge roller to the development roller is in the range of approximately 1.01 to approximately 1.06, preferably in the range of approximately 1.02 to approximately 1.03.

In addition, the diameter ratio I (I=D2/D1) of the subsidiary charge roller to the development roller is preferably in the range of approximately 0.45 to approximately 0.80.

Furthermore, the frictional coefficients of the surfaces of the subsidiary charge roller and the development roller are preferably in the range of approximately 0.1 to approximately 0.5 when the coefficients are measured using a 33 g weight.

According to another embodiment of the present invention, an image forming apparatus is provided comprising a photosensitive conductor for forming a developer image, and a development roller for attaching developer to the electrostatic latent image formed on a surface of the photosensitive conductor, thereby developing the electrostatic latent image into the developer image. The apparatus also includes a developer layer regulation member for regulating a developer layer deposited onto the development roller, wherein the developer layer regulation member can be positioned adjacent to the development roller, and a subsidiary charge roller for charging the developer in the developer layer, wherein the subsidiary charge roller can be located after, or downstream of the developer layer regulation member in the rotational direction of the development roller. In such a position, the subsidiary charge roller comes into contact with the development roller with a predetermined pressure while forming a predetermined gap with the development roller. The subsidiary charge roller further comprises a subsidiary charge roller gear being arranged coaxially on the shaft of the subsidiary charge roller and being meshed with a development roller gear coaxially formed on the shaft of the development roller.

According to an exemplary embodiment of the present invention, the subsidiary charge roller gear comprises a number of teeth having a predetermined range of a minus addendum modification for allowing the subsidiary charge roller gear to be suitably meshed with the development roller gear, and the subsidiary charge roller to be engaged with the development roller, thereby forming a predetermined nip. The minus addendum modification is preferably in the range of approximately −0.05 to approximately −0.3.

In addition, the subsidiary charge roller gear is arranged to be driven by a driving force transmitted from a first driving motor that drives the photosensitive conductor, or a second driving motor that is different from the first driving motor. It is more preferable that the driving force be transmitted to the subsidiary charge roller gear via the development roller gear, rather than the driving force being directly transmitted to the subsidiary charge roller gear.

The image forming apparatus can further comprise a compression section for directing the subsidiary charge roller and the development roller into contact with each other with a predetermined pressure. The compression section preferably comprises one or more elastic springs arranged to compress the opposite ends of the shaft of the subsidiary charge roller with a predetermined line pressure in such a manner that the subsidiary charge roller side has a higher compressive pressure than the development roller side.

BRIEF DESCRIPTION OF THE DRAWINGS

The above and other objects, features and advantages of the present invention will be more apparent from the following detailed description taken in reference with the accompanying drawings, in which.

In the above figures, like reference numbers are used to refer to like features and structures.

DETAILED DESCRIPTION OF THE EXEMPLARY EMBODIMENTS

Figure 1:
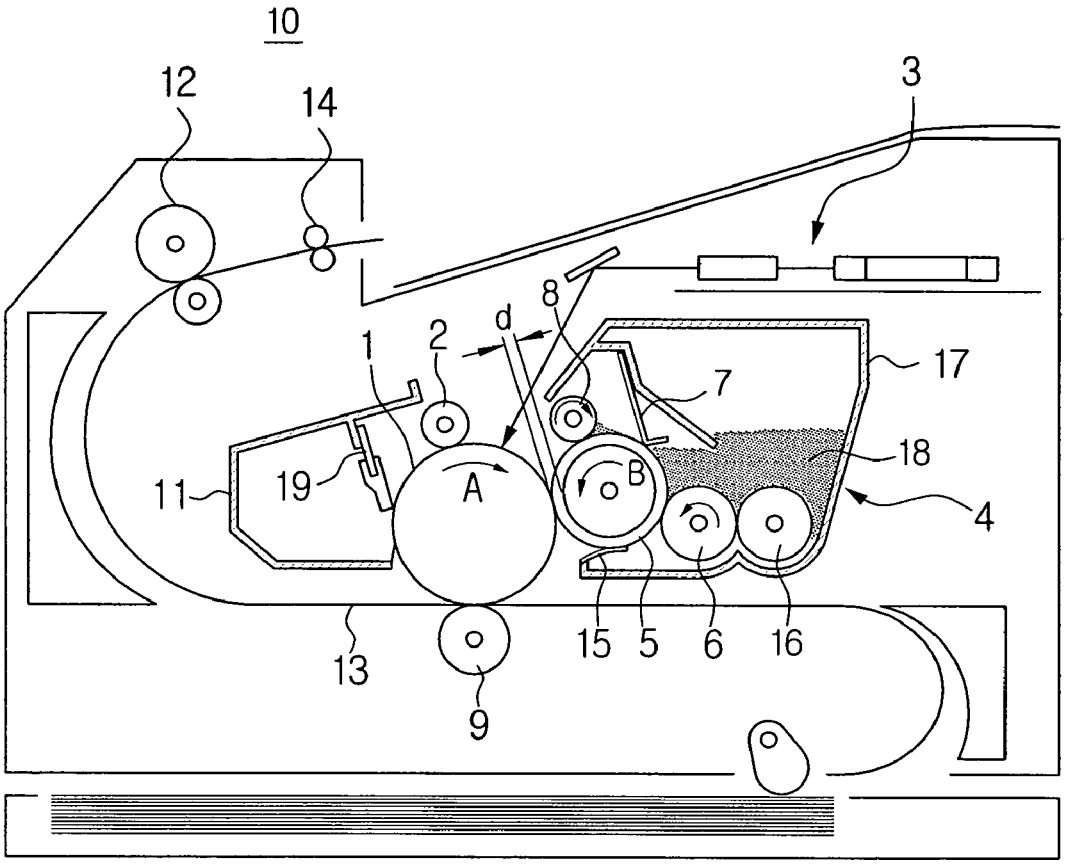
FIG. 1 (PRIOR ART)
FIG. 1 is a cross-sectional view showing a conventional image forming apparatus.
Figure 2:
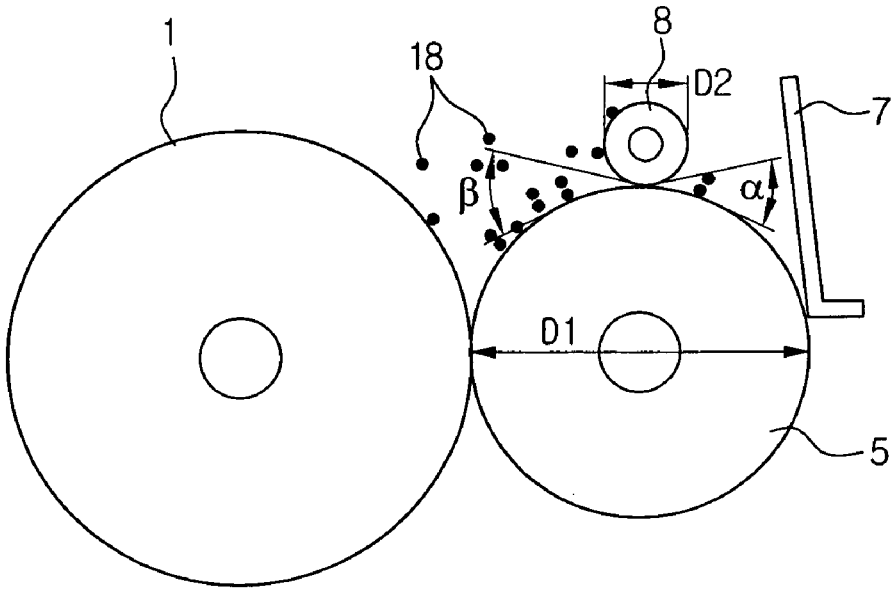
FIG. 2 (PRIOR ART)
FIG. 2 is a cross-sectional view showing a part of the image forming apparatus shown in FIG. 1 for illustrating the problems of the subsidiary charge roller of the conventional apparatus.
Figure 3:
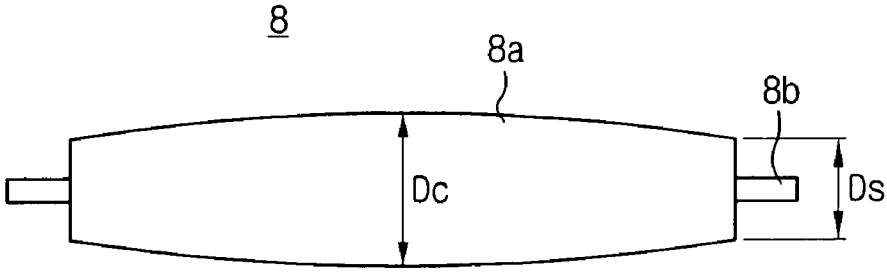
FIG. 3 (PRIOR ART)
FIG. 3 is a front view of the subsidiary charge roller of the image forming apparatus shown in FIG. 1.

Hereinbelow, exemplary embodiments of the present invention will be described in greater detail with reference to the accompanying drawings. In the following description, like parts to those of the devices described above will be indicated with like reference numerals.

Figure 4:
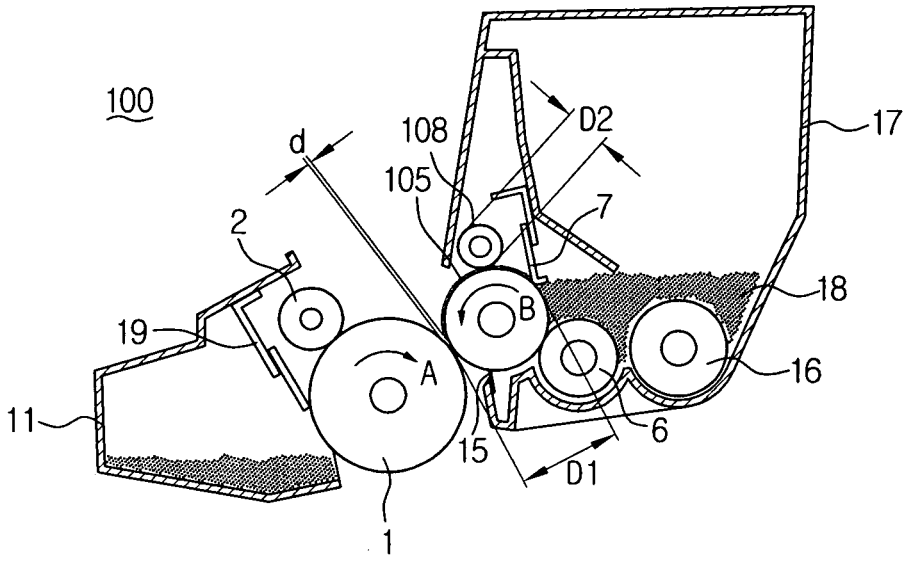
FIG. 4 is a cross-sectional view of a development unit for an image forming apparatus in which, a subsidiary charge roller according to an embodiment of the present invention is incorporated.

FIG. 4 shows a development unit 100 of an image forming apparatus according to an exemplary embodiment of the present invention in which, a subsidiary charge roller is incorporated.

The development unit 100 comprises a development roller 105 spaced from a photosensitive conductor 1 by a predetermined gap d, and a developer supply roller 6 for supplying developer 18 containing nonmagnetic one-component toner, wherein the developer supply roller 6 is positioned adjacent to the development roller 105 and is rotating in a same direction with the development roller 105 as indicated by arrow B in FIG. 1. The unit also includes a stirring roller 16 for stirring developer stored in a developer bin 17, and a developer layer regulation member 7 for regulating a developer layer formed on the development roller 105. A subsidiary charge roller 108 is provided for evenly charging the developer 18 in the developer layer formed by the developer layer regulation member 7, and a leakage prevention member 15 is provided for preventing the developer 18 from leaking out, wherein the leakage prevention member 15 can be located below the development roller 105.

Among the constituent elements described above, with the exception of the development roller 105 and the subsidiary charge roller 108, the elements are substantially the same as those of the development unit 4 of the image forming apparatus described with reference to FIG. 1 and thus, detailed descriptions thereof are omitted.

Figure 7:
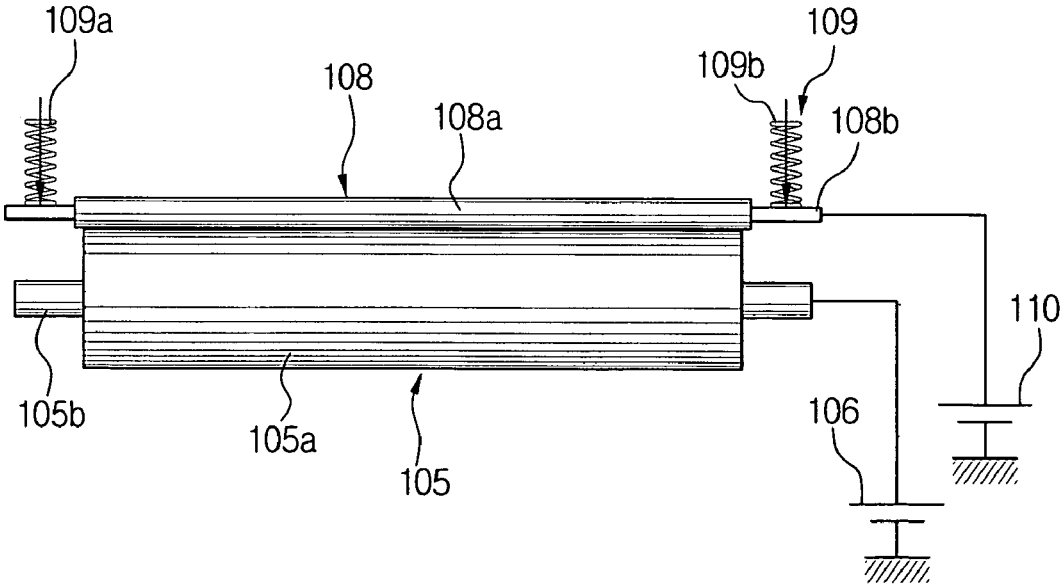
FIG. 7 is a partial front view showing a compression section for directing the subsidiary charge roller into contact with the development roller with a predetermined line pressure in the development unit shown in FIG. 4.

As shown in FIG 7, the development roller 105 comprises a roller shaft 105*b*, and a roller 105*a* which can be constructed of a urethane-based material having a surface roughness Rz in the range of approximately 2 to approximately 20 μm, preferably in the range of approximately 3.0 to approximately 12.0 μm (Ra=1.0 to 3.0 μm).

A developing bias voltage (Vdev) in the range of about −300 to about −600 V, preferably, of about −500 V is applied to the development roller 105 via a developing voltage application section 106.

In this example, the development roller 105 is illustrated and described as spaced from the photosensitive conductor 1 by the predetermined gap d, but it can be constructed to be in contact with the photosensitive conductor 1.

The subsidiary charge roller 108 comprises a roller shaft 108*b*, and a roller 108*a* (FIG. 7) which can be constructed of a urethane-based material having a surface roughness Rz in the range of approximately 1 to approximately 15 μm, preferably in the range of approximately 2 to approximately 10 μm.

The surface of the roller 108*a* when constructed of the urethane-based material is formed with a conductive tube or a conductive coating layer formed from a Teflon material containing a fluorine (F) component, and having a thickness in the range of approximately 0.1 to approximately 0.5 mm, wherein the conductive coating layer can be provided through a spray coating or dipping process.

In order to evenly charge the developer 18, a charge bias voltage Vsub in the range of about −500 V to about −2000 V, is applied to the subsidiary charge roller 108 through the charge voltage application section 110. Preferably, the subsidiary charge roller 108 has an electric resistance in the range of approximately 1×10 Ω to approximately $1\times10^{10}$ Ω.

The amount of nip between the development roller 105 and the subsidiary charge roller 108 is in the range of approximately 0.1 mm to approximately 3.0 mm, preferably in the range of approximately 0.1 mm to approximately 1.0 mm.

The development roller 105 and the subsidiary charge roller 108 can also be formed to have a difference in hardness of about 10 degrees, when measured in Asker-C scale using a 500 g weight. For example, it is preferable that the hardness of the development roller 105 is approximately 45±5 degrees (Asker-C scale) and the hardness of the subsidiary charge roller 108 is greater than approximately 60 degrees (Asker-C scale).

The amount of nip between the development roller 105 and the subsidiary charge roller 108 can be controlled in accordance with the hardnesses of these rollers and the line pressure exerted on the development roller 105 by the subsidiary charge roller 108.

Figure 5:
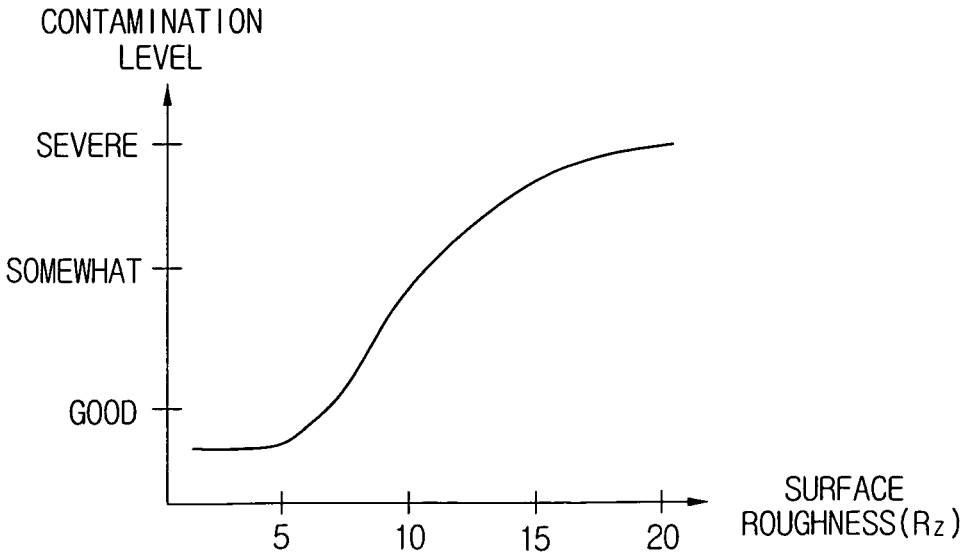
FIG. 5 is a graph illustrating the relationship between the surface roughness Rz and surface contamination of the subsidiary charge roller of the development unit shown in FIG. 4.

FIG. 5 is a graph illustrating a relationship between the surface roughness Rz and surface contamination of the subsidiary charge roller 108 which was obtained as a result of a test in which 10,000 sheets of paper were printed.

The test was performed under the condition wherein the diameter D1 of the development roller 105 was about 20 mm, the developing bias voltage of the development roller 105 was about −500 V, the surface roughness Rz of the development roller 105 was 3.0 μm to 12.0 μm, the diameter D2 of the subsidiary charge roller 108 was about 10 mm, the charging bias voltage Vsub of the subsidiary charge roller 108 was about −1,000 V, and the velocity of the developing process was about 150.9 mm/s. In addition, a pipe-shaped photosensitive drum formed of aluminum and having a diameter of about 30 mm was used as the photosensitive conductor 1. A developer supply bias voltage which was higher than the developing bias voltage by 150 to 250 V, was applied to the developer supply roller 6, which comprised a roller formed from a silicon-based foam having a hardness of about 25 degrees (Asker-C scale) and a diameter of about 13 mm. A charging voltage in the range of −1200 V to −1500 V was applied to the charge roller of the charging unit 2, which comprised a roller having a diameter of about 13 mm and an urethane coating layer with a hardness of about 45 degrees (Asker-C scale) and a surface roughness Ra of not more than about 3 μm. A roller formed from nitrile rubber (NBR) foam with a diameter of about 18 mm and a hardness of about 40 degrees (Asker-C scale) was used as the transfer roller 9, and a blade formed from urethane-based rubber with a hardness of about 90 degrees (Asker-C scale) was used as the cleaning blade 19.

As shown in FIG. 5, it can be seen from this test that the surface contamination of the subsidiary charge roller 108 becomes very severe when the surface roughness Rz of the subsidiary charge roller 108 is greater than 10 μm, in particular greater than 15 μm.

As noted above, the diameter ratio I (I=D2/D1) of the subsidiary charge roller 108 to the development roller 105 is determined to preferably be in the range of approximately 0.45 to approximately 0.80, more preferably in the range of approximately 0.5 to approximately 0.80. For example, in the above test, if the development roller 105 has a diameter of about 20 mm, then the subsidiary charge roller 108 should have, and does have a diameter of about 4 to about 16 mm. The impact of the diameter ratio is more clearly shown in Table 1 below.

The following Table 1 illustrates values for surface contamination level of the subsidiary charge roller 108, image contamination level due to scattering of developer, and charge quantity of developer Q/M with respect to the diameter ratio I. The values were obtained by changing the diameter D2 of the subsidiary charge roller 108 and printing 10,000 sheets of paper under same test conditions as those illustrated in the results of FIG. 5, except that the surface roughness Rz of the subsidiary charge roller 108 was about 7 μm. In this example, the diameter ratio is determined by changing the diameter D2 of the subsidiary charge roller 108 from 4 to 16 mm, while the diameter D1 of the development roller 105 is 20 mm.

TABLE 1

| | Diameter Ratio | | | | | | |
|---|---|---|---|---|---|---|---|
| Checking Items | 0.2 | 0.3 | 0.4 | 0.5 | 0.6 | 0.7 | 0.8 |
| Surface Contamination Level of Subsidiary Charge roller | S | S | A | G | V | V | V |
| Image Contamination Level due to Scattering | S | A | G | V | V | V | V |
| Charge Quantity of Developer (Q/M) (μQ/g) | 10–14 | 12–16 | 15–18 | 18–22 | 19–23 | 19–23 | 19–23 |

S: severe,
A: average,
G: good,
V: very good

As can be seen from Table 1, it was determined that when the diameter ratio is less than 0.5, in particular less than 0.45, the levels of surface contamination of the subsidiary charge roller and image contamination, such as spots, background or the like, due to scattering, are severe, whereas when the diameter ratio is greater than 0.5, all items are substantially good or better.

Figure 6:
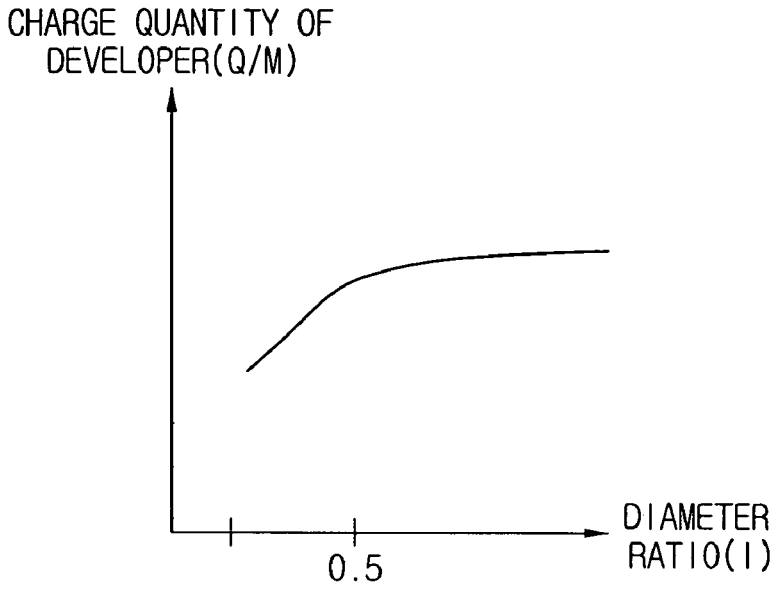
FIG. 6 is a graph illustrating the relationship between the diameter ratio I, that is, the ratio of the subsidiary charge roller to the development roller, and charge quantity Q/M of the developer roller in the development unit shown in FIG. 4.

As shown in the graph of FIG. 6 and on the basis of Table 1, the charge quantity of developer Q/M on the surface of the development roller 105 is more stabilized as the diameter ratio I is increased, and the charge quantity is evenly maintained when the diameter ratio I is greater than 0.5.

As shown in FIG. 7, in order to ensure that the subsidiary charge roller 108 and the development roller 105 are in contact with each other with a predetermined line pressure, the development unit 100 of the image forming apparatus can further include a compression section 109.

The compression section 109 comprises elastic springs 109*a* and 109*b* in the form of compression springs located at the opposite ends of the shaft 108*b* of the subsidiary charge roller 108, and a fixed frame (not shown) of the development unit 100, such that the opposite ends of the shaft 108*b* will be compressed against the development roller 105 with a predetermined pressure.

The compression section 109 allows the subsidiary charge roller 108 to be in contact with the development roller 105 with a predetermined pressure and also allows a nip to be evenly formed between the subsidiary charge roller 108 and the development roller 105 within a predetermined range of line pressure.

Although in the example illustrated and described, the compression section 109 consists of the elastic springs 109*a* and 109*b* provided in the form of compression springs herein, it can be possible to employ other elastic fixing means such as a leaf spring, that can suitably compress the opposite ends of the shaft 108*b*.

The line pressure of the subsidiary charge roller 108 against the development roller 105 is preferably in the range of approximately 8 gf/cm to approximately 100 gf/cm, and more preferably in the range of approximately 10 gf/cm to approximately 50 gf/cm. The line pressure is calculated by summing the elastic force of the elastic springs 109*a* and 109*b*, which serve to compress the opposite ends of the shaft 108*b* of the subsidiary charge roller 108 with a predetermined pressure, and the weight of the subsidiary charge roller 108. The impact of the line pressure of the subsidiary charge roller 108 against the development roller 105 is more clearly shown in the graphs of FIGS. 8A, 8B and 8C.

Figure 8A:
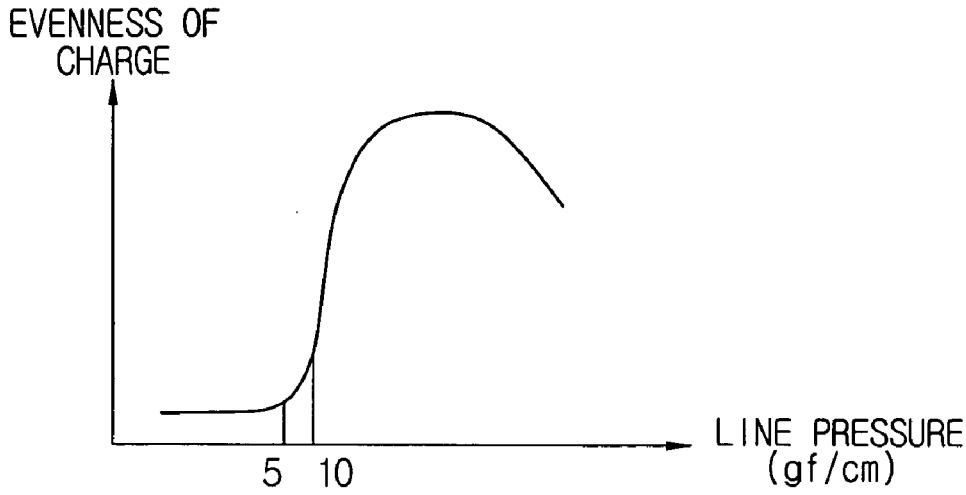
FIGS. 8A, 8B and 8C are graphs illustrating the relationships of quality of image, evenness of charge, and developer stress and/or roller filming, with respect to the line pressure of the subsidiary charge roller of the development unit shown in FIG. 4.

FIG. 8A illustrates test results under similar conditions with those of the test related to FIG. 5, except that the roughness Rz of the subsidiary charge roller 108 is about 7 μm. Specifically, as can be seen from the graph shown in FIG. 8A, which shows the results obtained through a test performed while changing the line pressure only, when the line pressure is less than a certain level, for example, when it is less than 5 gf/cm, the developer is not normally charged even if the charging bias voltage Vsub is tuned. According to the test results of FIG. 8A, it can be observed that the line pressure for initiating a proper even charge is approximately 8 gf/cm.

If the line pressure is too high however, it can result in contaminating the subsidiary charge roller 108 because developer is adhered to the subsidiary charge roller 108 due to the excessive line pressure, although the evenness of charge is not affected by the line pressure.

Figure 8B:
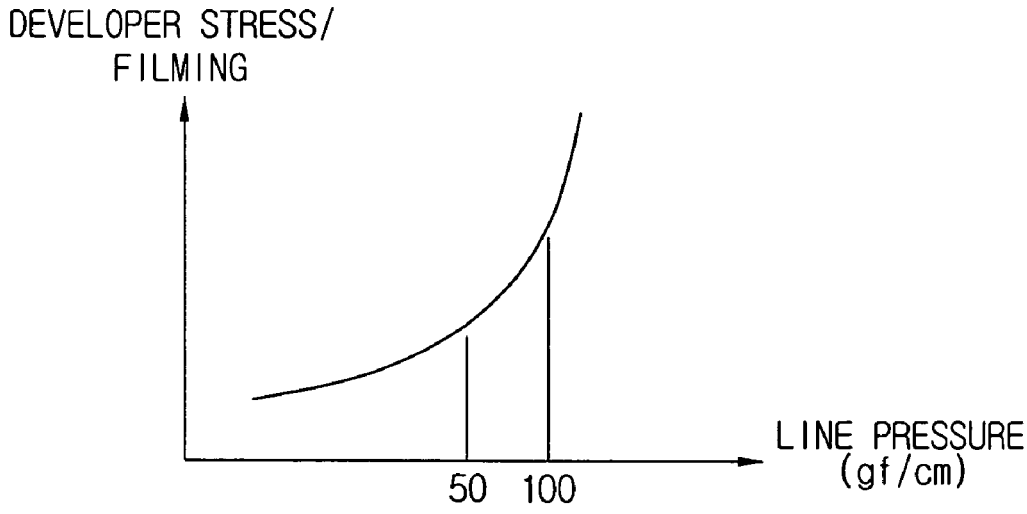
Figure 8C:
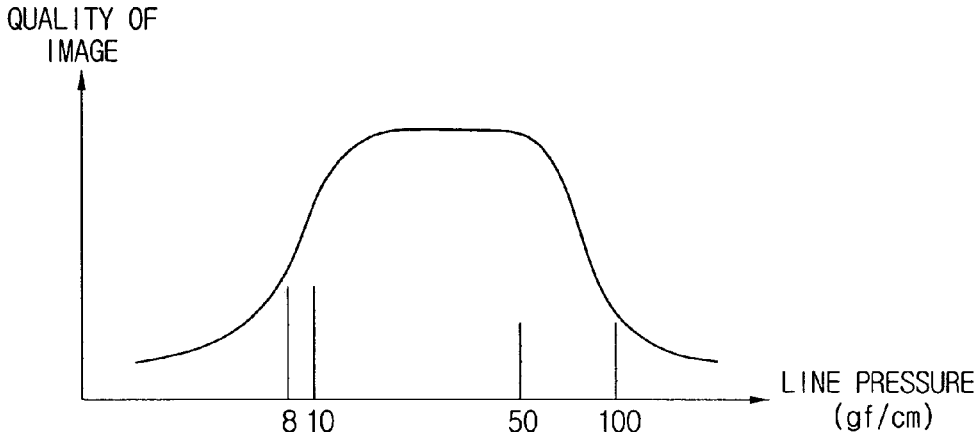

In addition, as shown in FIG. 8B, if the line pressure is too high, for example, if it exceeds 100 gf/cm, the developer 18 undergoes excessive stress. Such stress of the developer 18 deteriorates normal chargeable properties of the developer, thereby deteriorating developing capability, transfer capability, and charge capability. In addition, the excessive stress of the developer facilitates the separation of external additives and thus, deteriorates the adhesive force of toner particles deposited onto the development roller 105, thereby resulting in a problem of scattering of developer. The scattering of developer can result in the development unit 100 and printing matters, such as papers, to become contaminated and reduce the life-span of the developer.

Furthermore, if the line pressure exceeds 100 gf/cm, a filming phenomenon can be produced which results in the developer 18 becoming scorched and stick to the subsidiary roller 108 and the development roller 105, or results in the components of the subsidiary roller 108 or the development roller 105 to become scorched and sticking to the mating roller 105 or 108.

The tests described above illustrate that the line pressure of the subsidiary charge roller 108 against the development roller 105 should not exceed 100 gf/cm, and in particular it is preferred that the line pressure should not exceed 50 gf/cm.

In this embodiment example, if the line pressure of the subsidiary charge roller 108 against the development roller 105 is within the range of approximately 8 gf/cm to approximately 100 gf/cm, preferably in the range of approximately 10 gf/cm to approximately 50 gf/cm, and the difference in hardness between the two rollers 105 and 108 exceeds about 10 degrees (Asker-C scale), the amount of nip between the development roller 105 and the subsidiary charge roller can be maintained in the range of approximately 0.1 mm to approximately 3 mm, and more preferably in the range of approximately 0.1 mm to approximately 1 mm.

When such a development roller 105 rapidly rotates in a high speed image forming apparatus, the rotational velocity of the subsidiary charge roller 108 can be higher than that of the development roller 105 in order to prevent the subsidiary charge roller 108 from slipping against the development roller 105 and to prevent problems of uneven charge and scattering of developer 18.

Accordingly, it is preferable that the subsidiary charge roller 108 and the development roller 105 are driven in such a manner that their linear velocities meet with the relationship defined by equation (1) and repeated below:

$$Vs(Vs=D2*Ws)>Vd(Vd=D1*Wd) \quad (1)$$

wherein D2 denotes a diameter or outer diameter (mm) of the subsidiary charge roller 108, Ws denotes a rotational angular velocity (rad/sec) of the subsidiary charge roller 108, D1 denotes a diameter or outer diameter (mm) of the development roller 105, and Wd denotes a rotational angular velocity (rad/sec) of the development roller 105.

In particular, the linear velocity ratio K (K=Vs/Vd) of the subsidiary charge roller 108 to the development roller 105 is preferably in the range of approximately 1.01 to approximately 1.06. That is, it is preferable that the subsidiary charge roller 108 rotates approximately 1.01 to approximately 1.06 times as fast as the development roller 105. The impact of the rotation of the subsidiary charge roller 108 and the development roller 105 is more clearly shown in the graph of FIG. 9.

Figure 9:
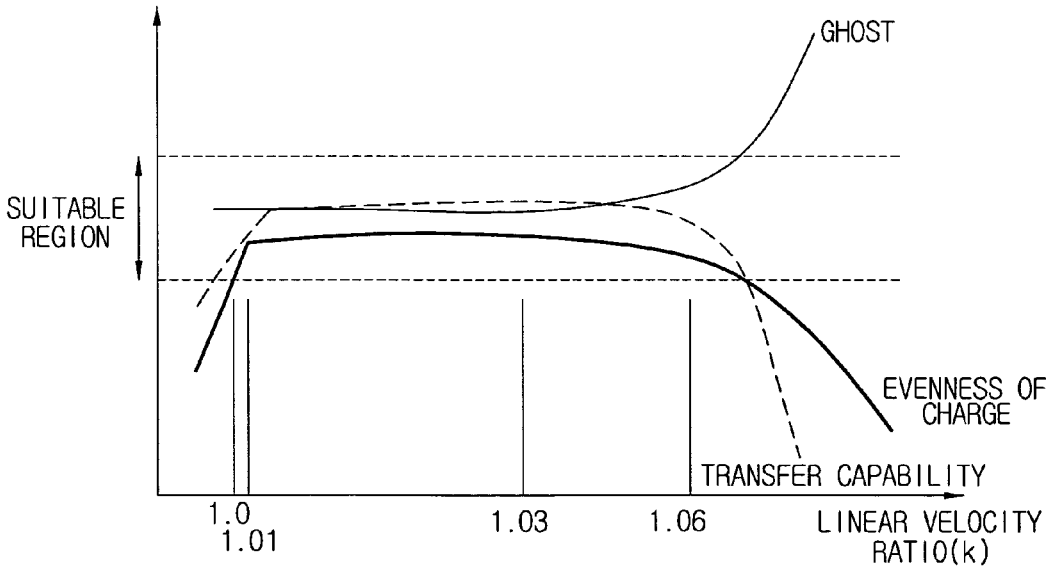
FIG. 9 is a graph illustrating the relationships of image ghost, evenness of charge and transfer capability, with respect to the linear velocity ratio I of the subsidiary charge roller to the development roller in the development unit shown in FIG. 4.

FIG. 9 illustrates test results under similar conditions with those of the test related to FIG. 5, except that the roughness Rz of the subsidiary charge roller 108 is about 7 μm. Specifically, as can be seen from the graph of FIG. 9, which shows the results obtained through a test performed while changing linear velocity ratio K only, the even charging of the developer becomes difficult and transfer capability is deteriorated if the linear velocity ratio K is in the range of approximately 1.00 to approximately 1.01.

In addition, because the adhesive force by the charge of the developer 18 becomes too great if the linear velocity ratio K is greater than 1.06, the developer 18 will remain on the development roller 105 without being developed due to the excessive adhesive force by charge, thereby producing a ghost image. Furthermore, the excessive adhesive force by the charge of the developer 18 will require a higher transfer voltage at the time of development, whereby the area of transfer voltage will be narrowed and thus transfer capability will be deteriorated.

Accordingly, in this example the preferred linear velocity ratio K which results in a desired evenness of charge and transfer capability, and minimizes ghost image, is in the range of approximately 1.01 to approximately 1.06, preferably in the range of approximately 1.02 to approximately 1.03.

In addition, if the subsidiary charge roller 108 is driven by the contact frictional force with the development roller 105, it is preferred that the development roller 105 and the subsidiary roller 108 have a frictional coefficient in the range of approximately 0.1 to approximately 0.5, wherein the frictional coefficient is measured using a known method, such as a method which measures a frictional coefficient by drawing a string with a 33 g weight tied at one end through a roller. If the frictional coefficient is less than 0.1, the subsidiary charge roller 108 can be prone to slip against the development roller 105, whereas if the frictional coefficient is greater than 0.5, the subsidiary charge roller 108 may be severely contaminated by developer.

Figure 10A:
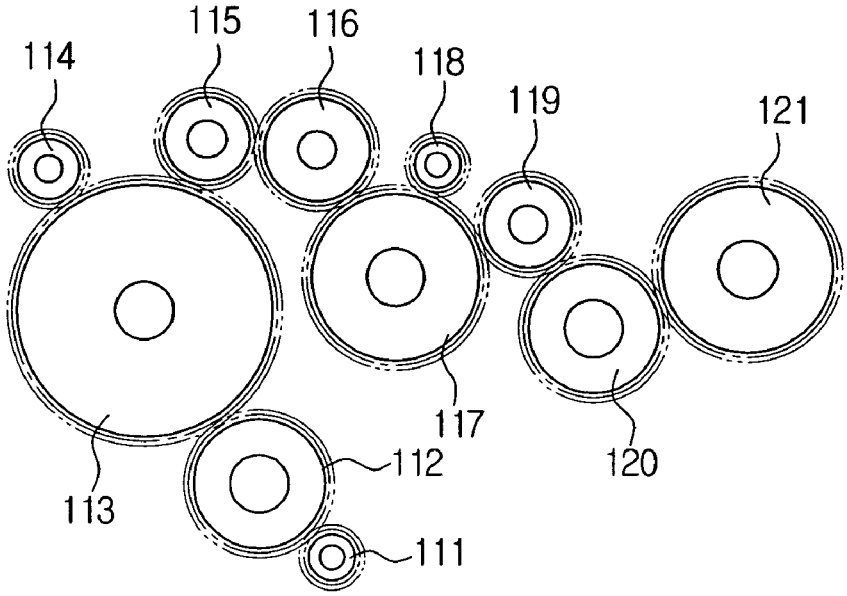
FIGS. 10A and 10B are side views showing the connective relationship of gears for driving the subsidiary charge roller of the development unit shown in FIG. 4.

As shown in FIG. 10A, in order to prevent slippage of the subsidiary charge roller as the subsidiary charge roller 108 is driven by the contact frictional force with the development roller 105, the subsidiary charge roller 108 can further comprise a subsidiary charge roller gear 118 coaxially formed on the shaft 108*b* of the subsidiary charge roller 108 and positioned to be meshed with a development roller gear 117 coaxially formed on the shaft 105*b* of the development roller 105.

The subsidiary charge roller gear 118 is driven by the driving force transmitted from a first driving gear 111 of a first driving motor (not shown) which is provided for driving the photosensitive conductor 1.

That is, the subsidiary charge roller gear 118 is connected to the first driving gear 111 of the first driving motor through the photosensitive conductor driving gear 112, a charge roller gear 114 which is provided to drive a photosensitive conductor gear 113, first and second idler gears 115 and 116, and the development roller gear 117. The development roller gear 117 also transmits the driving force of the first driving motor to a third idler gear 119, a developer supply roller gear 120 and a stirring roller gear 121.

Figure 10B:
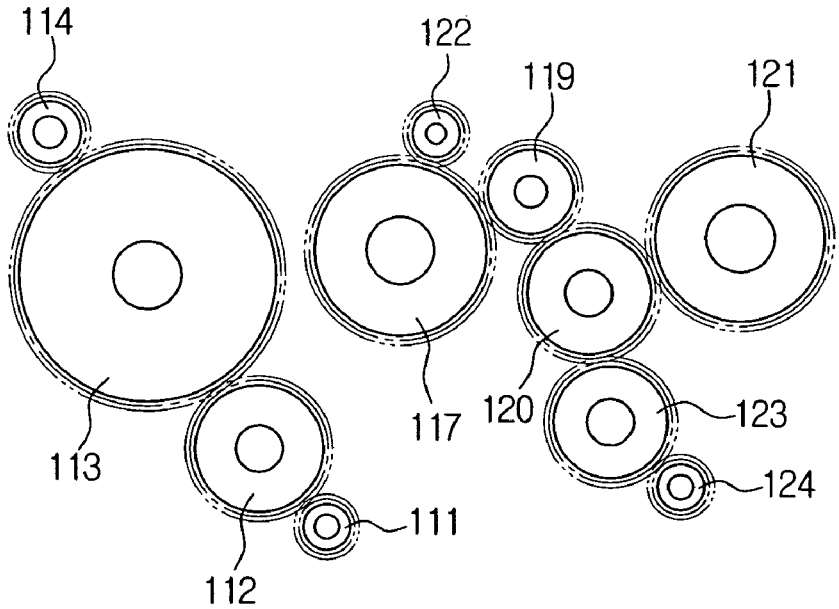

Alternatively, as shown in FIG. 10B, the subsidiary charge roller gear 122 can be driven by a second driving gear 124 of a second driving motor (not shown) which is different from the first driving motor.

In this case, the subsidiary charge roller gear 122 is connected to the second driving gear 124 of the second driving motor through a fourth idler gear 123, the development roller gear 120 which is provided to drive the stirring roller gear 121, the third idler gear 119, and the development roller gear 117, rather than being connected to the first driving gear 111 of the first driving motor as described above.

Regardless of how driven, the subsidiary charge roller gear 118 or 122 can include teeth having a minus addendum modification in the range of approximately −0.05 to approximately 0.3 for allowing the subsidiary charge roller gear 118 or 122 to be suitably meshed with the development roller gear 117, such that a nip in the range of approximately 0.1 mm to approximately 3 mm can be formed between the development roller 105 and the subsidiary charge roller 108 when the development roller 105 and the subsidiary charge roller 108 are engaged with each other.

When the subsidiary charge roller gear 118 or 122 is driven by the first or second driving motors, the change of nip between the subsidiary charge roller 108 and the development roller 105 resulting from an axial force between the subsidiary charge roller 108 and the development roller 105 can be compensated because the opposite ends of the shaft 108*b* of the subsidiary charge roller 108 are compressed toward the development roller 105 by the elastic springs 109*a* and 109*b* of the compression section 109 as shown in FIG. 7. Therefore, the subsidiary charge roller 108 can evenly charge the developer without suffering from a change of nip with the development roller 105 in the left and right directions.

The development unit 100 of the image forming apparatus comprising the subsidiary charge roller 108 constructed as described above can be operated in the same manner as that of the conventional image forming apparatus shown in FIG. 1, with the exception of the construction and operating conditions of the subsidiary charge roller 108 and the development roller 105 which have predetermined diameter ratio I, line pressure, linear velocity ratio K, and frictional coefficient values as specified above. Still another exception can exist wherein the subsidiary charge roller 108 can be driven by the subsidiary charge roller gear 118 or 122 connected to the development roller gear 117. Therefore, a detailed description of the operation of the development unit 100 is omitted.

As described above, it can be appreciated that the image forming apparatus in accordance with the present invention and comprising a subsidiary charge roller substantially prevents the deterioration of image quality due to uneven charge, and surface contamination of the subsidiary charge roller due to the offset of developer on the subsidiary charge roller. The apparatus further prevents pollution due to scattering of developer, as the subsidiary charge roller is formed in such a manner that the diameter ratio I of the subsidiary charge roller to the development roller is maintained within a predetermined range.

In addition, the image forming apparatus in accordance with the present invention further substantially prevents the deterioration of image quality due to uneven charge, scattering of developer and decrease in image density under special environments such as a low-temperature and low-humidity environments, and high-temperature environments. The apparatus further prevents the decrease of the life-span of the developer and the deterioration of image quality due to increased stress of developer, as the line pressure of a subsidiary charge roller against a development roller is configured to be maintained within a predetermined range.

Furthermore, the image forming apparatus in accordance with the present invention can prevent the decrease of the life-span of the developer and the deterioration of image quality due to increased stress of developer, uneven charge due to slippage of the subsidiary charge roller, and the deterioration of image quality due to the uneven charge, as the linear velocity ratio of the subsidiary charge roller to the development roller is configured to be maintained within a predetermined range.

The image forming apparatus in accordance with the present invention is configured such that a subsidiary charge roller can be driven by a subsidiary charge roller gear which receives the driving force transmitted from a driving motor, such as a photosensitive conductor driving motor, without being driven by the contact frictional driving force with a development roller. In this configuration, it is possible to prevent inferior development, pollution of developer, uneven charge due to slippage of the subsidiary charge roller, and the deterioration of image quality due to the uneven charge, all of which can result from poor operation of bearings supporting opposite ends of the subsidiary charge roller shaft.

While the exemplary embodiments of the present invention have been shown and described with reference to the representative embodiments thereof in order to exemplify the principle of the present invention, the present invention is not limited to the embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. An image forming apparatus comprising:

a photosensitive conductor for forming a developer image;

a development roller for attaching a developer onto an electrostatic latent image formed on a surface of the photosensitive conductor, thereby developing the electrostatic latent image into the developer image;

a developer layer regulation member for regulating a developer layer deposited onto the development roller, the developer layer regulation member being positioned adjacent to the development roller; and a subsidiary charge roller for charging the developer in the developer layer, the subsidiary charge roller being located after the developer layer regulation member in the rotational direction of the development roller such that the subsidiary charge roller comes into contact with the development roller with a predetermined pressure while forming a predetermined gap with the development roller, wherein the diameter ratio I of the subsidiary charge roller to the development roller is in the range of approximately 0.45 to approximately 0.8, and the subsidiary charge roller has a surface roughness Rz in the range of approximately 1 to approximately 15.

2. An image forming apparatus as claimed in claim 1, wherein the diameter ratio I is in the range of approximately 0.5 to approximately 0.8.

3. An image forming apparatus as claimed in claim 2, wherein a surface of the subsidiary charge roller comprises at least one layer of a conductive material containing a fluorine component.

4. An image forming apparatus as claimed in claim 3, wherein the subsidiary charge roller has an electrical resistance in the range of approximately 1×10 Ω to approximately $1\times10^{10}$ Ω.

5. An image forming apparatus as claimed in claim 2, wherein a nip amount between the development roller and the subsidiary charge roller is in the range of approximately 0.1 mm to approximately 1.0 mm.

6. An image forming apparatus as claimed in claim 1, wherein a surface of the subsidiary charge roller comprises at least one layer of a conductive material containing a fluorine component.

7. An image forming apparatus as claimed in claim 6, wherein the subsidiary charge roller has an electrical resistance in the range of approximately 1×10 Ω to approximately $1\times10^{10}$ Ω.

8. An image forming apparatus as claimed in claim 1, wherein a nip amount between the development roller and the subsidiary charge roller is in the range of approximately 0.1 mm to approximately 1.0 mm.

9. An image forming apparatus comprising:

a photosensitive conductor for forming a developer image;

a development roller for attaching a developer onto an electrostatic latent image formed on a surface of the photosensitive conductor, thereby developing the electrostatic latent image into the developer image;

a developer layer regulation member for regulating a developer layer deposited onto the development roller, the developer layer regulation member being positioned adjacent to the development roller;

a subsidiary charge roller for charging the developer in the developer layer, the subsidiary charge roller being located after the developer layer regulation member in the rotational direction of the development roller; and a compression section for compressing the subsidiary charge roller against the development roller such that the subsidiary charge roller exerts a line pressure in the range of approximately 8 gf/cm to approximately 100 gf/cm to the development roller, wherein a nip amount between the development roller and the subsidiary charge roller is in the range of approximately 0.1 to approximately 3.0 mm.

10. An image forming apparatus as claimed in claim 9, wherein the subsidiary charge roller has a surface roughness in the range of approximately 1 Rz to approximately 15 Rz.

11. An image forming apparatus as claimed in claim 10, wherein the line pressure is in the range of approximately 10 gf/cm to approximately 50 gf/cm.

12. An image forming apparatus as claimed in claim 10, wherein the line pressure is calculated by summing the predetermined compressing pressure and the weight of the subsidiary charge roller.

13. An image forming apparatus as claimed in claim 10, wherein the compression section comprises at least one elastic spring arranged to compress a first and second opposite end of a shaft of the subsidiary charge roller with a predetermined pressure.

14. An image forming apparatus comprising:

a photosensitive conductor for forming a developer image;

a development roller for attaching developer onto an electrostatic latent image formed on a surface of the photosensitive conductor, thereby developing the electrostatic latent image into the developer image;

a developer layer regulation member for regulating a developer layer deposited onto the development roller, the developer layer regulation member being positioned adjacent to the development roller; and a subsidiary charge roller for charging the developer in the developer layer, the subsidiary charge roller being located after the developer layer regulation member in the rotational direction of the development roller such that the subsidiary charge roller comes into contact with the development roller with a predetermined pressure while forming a predetermined gap with the development roller, and wherein the subsidiary charge roller is driven with a linear velocity Vs which is higher than the linear velocity Vd of the development roller, and the subsidiary charge roller has a surface roughness Rz in the range of approximately 1 to approximately 15.

15. An image forming apparatus as claimed in claim 14, wherein a linear velocity ratio K of the subsidiary charge roller to the development roller is in the range of approximately 1.01 to approximately 1.06.

16. An image forming apparatus as claimed in claim 15, the line velocity ratio is in the range of approximately 1.02 to approximately 1.03.

17. An image forming apparatus as claimed in claim 14, wherein a diameter ratio I of the subsidiary charge roller to the development roller is in the range of approximately 0.45 to approximately 0.80.

18. An image forming apparatus as claimed in claim 14, wherein a frictional coefficient of a contact surface of the subsidiary charge roller and a contact surface of the development roller is in the range of approximately 0.1 to approximately 0.5.

19. An image forming apparatus comprising:

a photosensitive conductor for forming a developer image;

a development roller for attaching developer onto an electrostatic latent image formed on a surface of the photosensitive conductor, thereby developing the electrostatic latent image into the developer image;

a developer layer regulation member for regulating a developer layer deposited onto the development roller, the developer layer regulation member being positioned adjacent to the development roller; and a subsidiary charge roller for charging the developer in the developer layer, the subsidiary charge roller being located after the developer layer regulation member in the rotational direction of the development roller such that the subsidiary charge roller comes into contact with the development roller with a predetermined pressure while forming a predetermined gap with the development roller, wherein the subsidiary charge roller further comprises a subsidiary charge roller gear which is arranged coaxially on the shaft of the subsidiary charge roller and meshed with a development roller gear which is arranged coaxially on the shaft of the development roller.

20. An image forming apparatus as claimed in claim 19 wherein, the subsidiary charge roller gear comprises teeth having a predetermined range of a minus addendum modification for allowing the subsidiary charge roller gear to be meshed with the development roller gear, and the subsidiary charge roller to be engaged with the development roller, and thereby forming a predetermined nip.

21. An image forming apparatus as claimed in claim 20, wherein the minus addendum modification is in the range of approximately −0.05 to approximately −0.3.

22. An image forming apparatus as claimed in claim 19, wherein the subsidiary charge roller gear is arranged to be driven by a driving force transmitted from at least one of a first driving motor that drives the photosensitive conductor, and a second driving motor.

23. An image forming apparatus as claimed in claim 22, wherein driving force is transmitted to the subsidiary charge roller gear via the development roller gear.

24. An image forming apparatus as claimed in claim 19, further comprising a compression section for directing the subsidiary charge roller and the development roller to be in contact with each other with a predetermined pressure.

25. An image forming apparatus as claimed in claim 24, wherein the compression section comprises at least one elastic spring arranged to compress the opposite ends of the shaft of the subsidiary charge roller with a predetermined line pressure such that the subsidiary charge roller side has a higher compressive pressure than that of the development roller side.

* * * * *